US006523939B1

(12) United States Patent
Ellson et al.

(10) Patent No.: US 6,523,939 B1
(45) Date of Patent: Feb. 25, 2003

(54) CHOOSING PRINT PASSES AND SPEED BASED ON REQUIRED NUMBER OF DROPS FOR EACH SWATH

(75) Inventors: Richard N. Ellson, Palo Alto, CA (US); David A. Mantell, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/440,424

(22) Filed: Nov. 15, 1999

(51) Int. Cl.[7] ..... B41J 2/135
(52) U.S. Cl. ..... 347/46
(58) Field of Search ..... 347/46, 20, 54, 347/44, 5, 9, 10, 11, 40

(56) References Cited

U.S. PATENT DOCUMENTS 5,531,818 A * 7/1996 Lin et al. ..... 106/31.28
5,923,349 A 7/1999 Meyer ..... 347/40
6,015,210 A * 1/2000 Kanematsu et al. ..... 347/87
6,174,037 B1 1/2001 Donahue et al. ..... 347/9
6,179,407 B1 * 1/2001 Bockman ..... 347/40

* cited by examiner

*Primary Examiner*—John S. Hilten
*Assistant Examiner*—K. Feggins
(74) *Attorney, Agent, or Firm*—Fay, Sharpe, Fagan, Minnich & McKee, LLP

(57) ABSTRACT

An acoustic ink printing device ejects droplets of at least one fluid onto a printing medium. The acoustic ink printing device includes at least one printing means for ejecting a respective one of the fluids. Each printing means includes at least one ejector, associated with at least one pixel on the printing medium, and a means for generating an acoustic wave to eject respective droplets from the ejectors to the respective pixels. A processor, electrically connected to each of the printing means, minimizes a number of scans each of the printheads makes over a current swath of the printing medium.

23 Claims, 2 Drawing Sheets

CHOOSING PRINT PASSES AND SPEED BASED ON REQUIRED NUMBER OF DROPS FOR EACH SWATH

BACKGROUND OF THE INVENTION

The present invention relates to acoustic ink printing ("AIP"). It finds particular application in conjunction with reducing the number of passes a printhead makes of a swath for increasing the speed at which an image is printed, and will be described with particular reference thereto. However, it is to be appreciated that the present invention is also amenable to other like applications.

Various fluid application technologies, such as printing technologies, have been developed. One such printing technology uses focused acoustic energy to eject droplets of marking material from a printhead onto a recording medium. This printing technology is known as acoustic ink printing ("AIP"). Printheads used in AIP devices typically include a plurality of droplet ejectors, each of which launches a converging acoustic beam into a pool of fluid (e.g., liquid ink). The angular convergence of this beam is selected so that the beam focuses at or near the free surface of the ink (i.e., at the liquid-air interface). Printing is performed by modulating the radiation pressure that the beam of each ejector exerts against the free surface of ink to selectively eject droplets of ink from the free surface.

Color printing is typically achieved by ejecting droplets of various colored inks from respective printheads. Varying numbers of droplets of the various colored inks are mixed to produce a wider gamut of colors. For example, inks of four (4) colors (e.g., cyan, magenta, yellow, and black ("CMYK")) are mixed to achieve a variety of colors in the CMYK gamut. The speed at which a printed output is produced is a function of the number of passes the printhead makes over the printing medium. More than one (1) pass is necessary when any one of the printhead ejectors does not deliver the needed ink to a given location (i.e., when any one of the printheads does not deliver enough of its ink to achieve the desired color at a specific pixel location) before the printhead moves out of range. Until now, there has been no means for controlling the number of droplets ejected from an AIP device printhead for reducing the printing time while maintaining a desired quality of the printed output. In fact, current AIP devices typically pass the printhead over the printing medium at least twice, regardless of the number of droplets that need to be ejected to achieve the desired color and/or quality.

In conventional ink-jet printing, various approaches have been used to control the number, overall pattern, size, and spacing of individual ink droplets ("dots") ejected from the ink-jet printhead and printed within a given surface area of media in order to control the print quality of the printed media. This is desirable to ensure that the droplets printed during one (1) "pass" of the ink-jet printhead relative to adjacent print media have adequate time to dry before another overlying pass is made over the same printed area.

Inadequate drying time of the droplets produces a number of undesirable characteristics in resultant print quality, depending upon the type of print media used. For example, in the field of color ink-jet where ink colors such as cyan, yellow, and magenta are printed over a given area in dot-on-dot ("DOD") fashion, excessive volumes of ink per unit area may be produced on the printing medium. Such excessive volumes cause the ink to bead-up and/or coalesce as a result of an over-saturation of ink on some areas.

In addition to having adequate time to dry, it is also desirable that dots of different passes, and within a given pass, dry uniformly and consistently. Non-uniform or inconsistent drying produce a number of undesirable print quality effects depending upon the media used. Inadequate drying time is one possible cause of non-uniform drying of the ink.

In an effort to avoid the above problems of beading, coalescence, and over-saturation using DOD printing, some color ink-jet printers implement dot-next-to-dot ("DND") printing processes. DND processes eject dots onto side-by-side pixels in a given printed area. DND printing processes typically require the printhead to pass over a swath of the printing medium more than one (1) time. In fact, the printhead in a conventional ink-jet printing device may make several passes over the swath. These pixels may, for example, form quadrants or other sections of a larger or super pixel as is known in the art, and color mixing takes place at the side or DND interface boundaries within the super pixel. This DND approach to color ink-jet printing is preferable to DOD printing processes where either large ink drop volumes (e.g., above about 20 pico-liters) or largely water based inks, or both, are used in printing on plain paper.

Another approach to solving the above problems in ink-jet printers is to produce complementary multiple-pass DOD ink-jet printing processes. In this approach successive multiple passes of an ink-jet printhead relative to the print media in a DOD process are performed so that a first ink swath is completed by the use of two successive ink passes. Each pass has dot patterns that are complementary to each other. Thereafter, a second swath is laid down immediately adjacent to the first swath. Like the first swath, the second swath is completed by the use of two successive ink passes having complementary dot patterns therein.

Although the approaches discussed above overcome some problems in ink-jet printers, they have other drawbacks and/or may not be appropriate for AIP devices. For example, while the DND approach works for devices producing drops having large ink volumes, it is not as beneficial for printing devices that produce relatively small drops. Because AIP devices are capable of producing drops of about five (5) pico-liters, or even two (2) pico-liters, the DND approach does not achieve the same benefits in AIP devices that are achieved in ink-jet printers. Furthermore, while the multiple-pass DOD ink-jet printing processes reduce beading, it may produce banding at the boundaries between adjacent print swaths.

Therefore, none of the above ink-jet printing processes are suitable for increasing the speed AIP devices while maintaining a desired quality of the printed output.

The present invention contemplates a new and improved AIP device and method which overcome the above-referenced problems and others.

SUMMARY OF THE INVENTION

An apparatus ejects droplets of at least one fluid onto a printing medium. At least one printhead stores a respective one of the at least one fluids. The droplets are ejected from the respective printheads. A processor, electrically connected to the means for ejecting the droplets, causes the droplets to be ejected from the printheads for minimizing a number of scans each of the printheads makes over a plurality of swaths on the printing medium.

In accordance with one aspect of the invention, each of the means for ejecting the droplets is associated with at least one pixel in the swath on the printing medium.

In accordance with a more limited aspect of the invention, the processor determines a maximum number of droplets that are capable of being ejected from each of the ejecting means during one of the scans for at least one of the pixels in the swath. The processor determines a desired number of droplets of each of the fluids to eject from the respective printheads for achieving a desired color in each of the pixels. Then, the processor determines an actual number of droplets of each of the fluids to eject from the respective printheads for minimizing the number of scans each of the printheads makes over the swath. The processor determines the actual number of droplets as a function of the desired number of droplets.

In accordance with an even more limited aspect of the invention, four printheads eject the droplets of four respective fluids having different colors.

In accordance with another aspect of the invention, the printheads eject the droplets of fluids including cyan, magenta, yellow, and black colors.

In accordance with a more limited aspect of the invention, the maximum number of droplets ejected from each of the ejecting means during one of the scans is five.

In accordance with an even more limited aspect of the invention, if the desired number of droplets for any of the fluids ejected from any of the printheads in the respective swath is greater than the respective maximum number of droplets, the actual numbers of droplets ejected from the printheads equals the respective maximum number of droplets.

In accordance with another aspect of the invention, if any of the actual numbers of droplets is greater than the respective maximum number of droplets, the respective ejecting means ejects the respective maximum number of droplets during a single one of the scans.

One advantage of the present invention is that it reduces the number of scans a printhead makes of each swath of a printing medium.

Another advantage of the present invention is that it increases the speed at which the pixels are printed on the printing medium.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
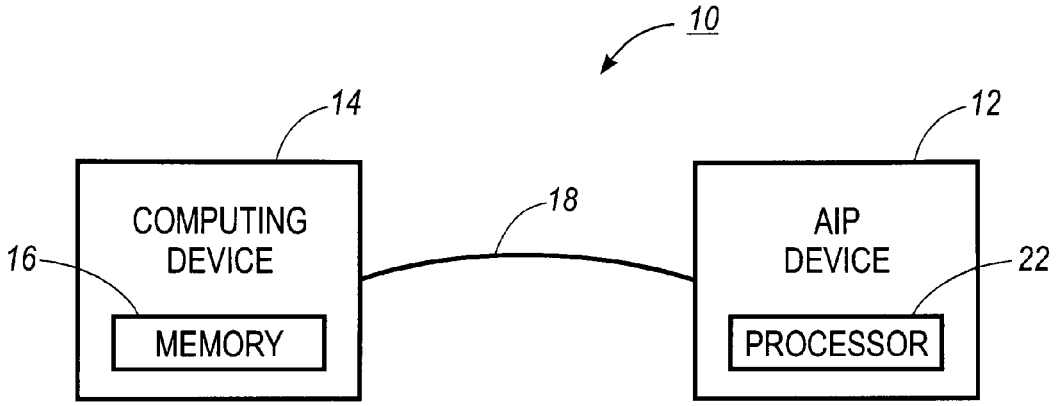
FIG. 1 illustrates an acoustic ink printing system according to the present invention.

FIG. 1 illustrates an acoustic ink printing system 10 for printing an image. The system includes an acoustic ink printing ("AIP") device 12 and a computing device 14. The computing device 14 includes a memory 16 for storing data, in a conventional format, of an image to be printed. When it is desirable to print the image, the computing device 14 transmits the image data from the memory 16 to the AIP device 12 via an electrical cable 18. A processor 22 within the AIP device 12 processes the image to be printed.

Figure 2:
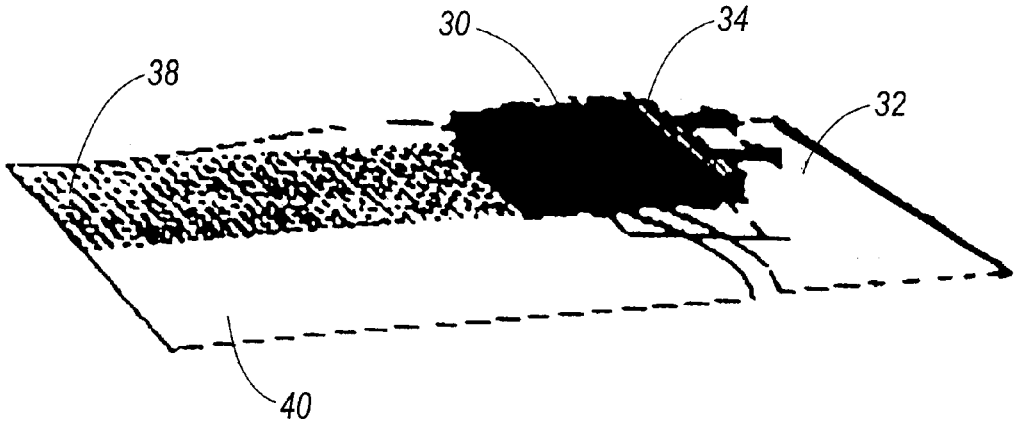
FIG. 2 illustrates an AIP device printhead positioned over a printing medium.
Figure 4:
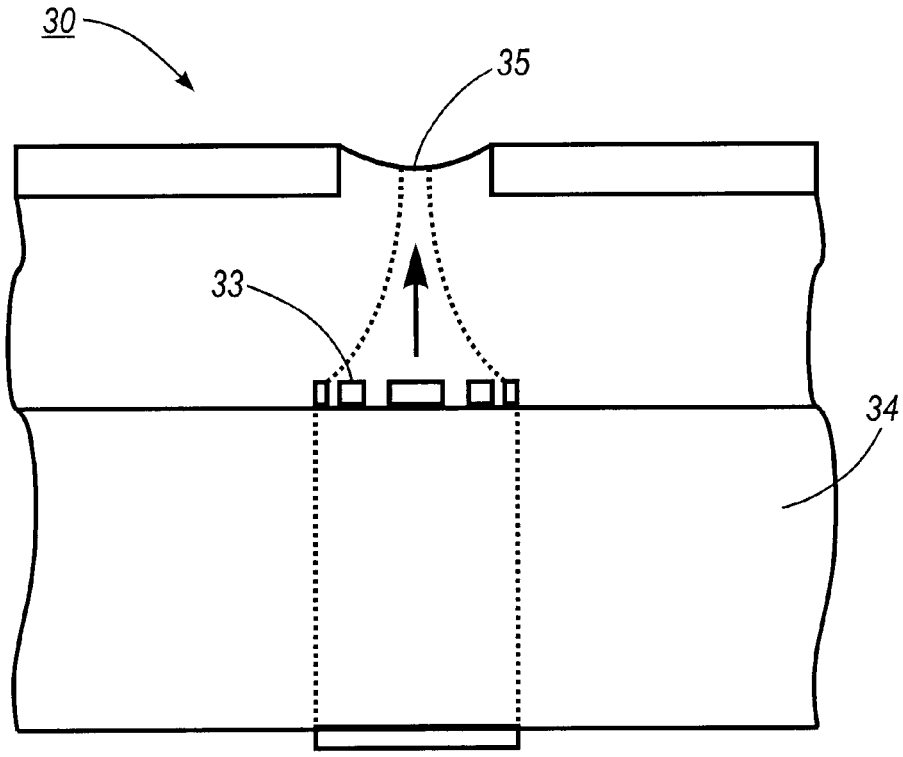
FIG. 4 illustrates an AIP device printhead.

FIG. 2 illustrates an AIP device printhead 30, which is positioned above a printing medium 32 (e.g., paper). The printhead 30 includes acoustic generators 33 for ejecting fluid from associated ejectors 35 (see FIG. 4). During a printing process, the printhead 30 moves (i.e., scans) across respective swaths 38, 40 of the printing medium 32. In the preferred embodiment, each of the swaths 38, 40 is about 1.7 inches wide. The printhead 30 ejects droplets of differently colored inks during each scan, thereby producing a wide gamut of colors on the printing medium 32. Preferably, the droplets are less than or equal to about five (5) pico-liters.

In the preferred embodiment, the printhead 30 ejects droplets of inks of four (4) different colors (i.e., cyan, magenta, yellow and black). Various numbers of the droplets of the four (4) colored inks are mixed to create all the colors achievable in the CMYK gamut. Although the preferred embodiment discloses four (4) differently colored inks, it is to be understood that other embodiments, including other numbers and colors of inks, are also contemplated.

The printhead 30 scans across the swaths 38, 40 of the printing medium 32 at a rate of about 16 inches per second ("ips"). Droplets are ejected from each ejector at a frequency of about 50 kHz. Therefore, up to five (5) droplets are ejected from each ejector to a corresponding 600 dot per inch pixel on the printing medium 32 during each scan of a swath. In this manner, up to five (5) droplets of each of the four (4) colored inks are ejected to a single pixel of the printing medium 32 during each scan of a swath.

Figure 3:
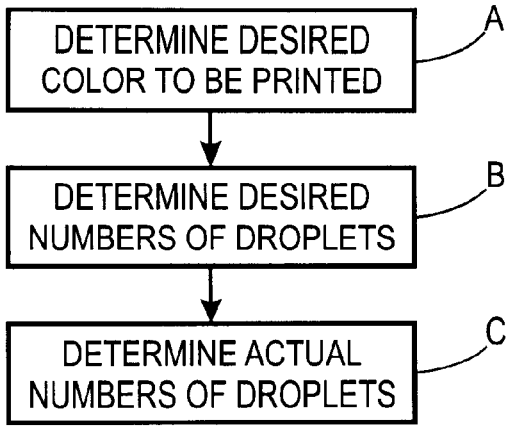
FIG. 3 illustrates a flowchart of a method for processing an image according to the present invention.

With reference to FIGS. 1–3, the AIP device 12 receives the image data from the computing device 14. The AIP device 12 includes a processor 22 for associating the image data with respective pixels on the printing medium 32. Each pixel is associated with a specific color in the CMYK color gamut in a step A. The processor 22 determines respective desired and actual numbers of droplets of each of the four (4) colors to apply to the printing medium 32 to form a pixel having the desired color and quality in respective steps B and C.

To achieve the desired color and quality in a pixel, the processor 22 determines the fewest number of scans that are required to produce the desired colors and quality for each of the pixels in the swath 38. If it is possible to produce the desired colors and quality for each of the pixels using five (5) or less droplets of each colored ink, the processor 22 causes the AIP device 12 to produce all of the droplets in one (1) scan. If it is only possible to produce the desired colors and quality for each of the pixels using ten (10) or less droplets of any one of the colored inks, the processor 22 causes the AIP device 12 to produce the droplets in two (2) scans. Similarly, if it is only possible to produce the desired colors and quality for each of the pixels using fifteen (15) or less droplets of each colored ink, the processor 22 causes the AIP device 12 to produce all of the droplets in three (3) scans. It is very rare that more than two (2) scans of a swath are necessary to achieve the desired results.

The process of determining the fewest number of scans that are required to produce the desired output for each of the pixels in a swath is referred to as gamut-skipping. The term "gamut" is used to describe all the colors that are achievable by a marking device. Like white-space skipping, which is well-known in the art of ink-jet printing, gamut-skipping causes the AIP device printhead 30 to completely skip any passes that do not require any ink to be laid on the printing medium. Gamut-skipping is used when all the pixel colors in the swath are within the gamut of the earlier scans, and, hence, have already been achieved by earlier passes. Furthermore, gamut skipping seeks to minimize the number of scans an AIP device printhead 30 makes over each swath 38, 40.

In an alternative embodiment, the printhead 30 of the AIP device 12 scans selected swaths of the printing medium more than once. More specifically, in some situations it is desirable for the printhead 30 to apply a first set of droplets (e.g., about 50%) to each of the pixels during a first scan and then apply a second set of droplets to each of the pixels (e.g., about 50%) during a second scan. Importantly, droplets of ink are applied to each of the pixels during each of the scans.

Splitting the colors across scans is not necessarily better than applying two (2) drops of a first color and three (3) drops of a second color in the first scan (and then vice-versa in a second scan. As an example, the processor 22 may determine that it is necessary to apply ten (10) droplets of an ink to a specific pixel. In this case, the printhead 30 of the AIP device 12 applies five (5) droplets of the ink to the pixel during each of two (2) scans of a swath including the pixel. Optionally, a time period between the scans allows the first five (5) droplets of the ink to dry before the second five (5) droplets are applied. It is to be understood that if, for example, seven (7) droplets of the inks are the be applied, the numbers of droplets applied during the respective scans can be apportioned in any of a variety of different manners. For example, four (4) droplets may be applied during the first scan and three (3) droplets may be applied during the second scan. Alternatively, other combinations in which, for example, three (3) droplets are applied during the first scan and four (4) droplets are applied during the second scan are also contemplated.

If more than one (1) colored ink is to be applied to the printing medium 32 during any one (1) scan, it is also contemplated to modulate the order in which the inks are applied. More specifically, if the printhead 30 is moving left-to-right across the printing medium 32, it may be desirable to print cyan and then yellow. Conversely, if the printhead is moving right-to-left, it may be desirable to print yellow and then cyan. However, different inks have different properties when applied to various printing mediums. Even high-surface tension inks, which are often used in AIP devices, may dry on the printing medium between scans. Once the ink is re-wet with ink ejected during a subsequent scan, though, the inks mix and resolve to form a final color that is independent of the order in which the inks are applied.

The number of droplets ejected from an AIP device printhead 30 to a specific pixel on a printing medium 32 is a function of a speed at which the printhead 30 passes over a swath 38. Therefore, if the speed of the printhead 30 is increased by a factor of two (2), only about one-half (½) the number of droplets are applied to the printing medium 32. Similarly, if the speed of the printhead 30 is decreased by a factor of two (2), about twice the number of droplets are applied to the printing medium 32. This relationship between the printhead speed and the number of droplets ejected from the printhead 30 represents a trade-off between speed and quality, and in particular the size of the color gamut which can be produced in the swath. Therefore, a user of the AIP device 12 must recognize that the quality of the output (such as color gamut) may be sacrificed if the output is desired in a shorter time. Furthermore, if a maximum number of droplets of any ink to be applied during a scan is found to be less than or equal to five (5), the speed of the printhead may be increased as a function which is inversely proportional to the maximum number of droplets. For example, if the maximum number of droplets to be applied is four (4), the speed of the printhead may be increased by a factor of 5/4. In this manner, the printhead dwells at each drop a shorter amount of time.

It is to be understood, however, that a higher quality output is produced by an AIP device if the time allotted for producing the output is increased. Importantly, not all portions of an image have the same gamut requirements. Therefore, the desired quality (i.e., the size of the gamut of the pixels in the swath) is determined for each swath. Furthermore, the swath is produced as quickly as possible by adjusting the traversal speed or the number of passes to generate the smallest possible gamut which still provides the requested colors and quality.

The AIP device 12 disclosed in the present invention is particularly beneficial for producing images having photographic quality. The time required for producing a photographic image may be reduced, for example, by replacing ten (10) drops of black ink with a combination of five (5) or fewer drops of each of cyan, magenta, yellow, and black inks. Therefore, a two (2) pass color, such as a ten (10) drop black, may be printed with a single pass color including a mixture of five (5) drops of black and some combination of five (5) or fewer drops of each of cyan, magenta, and yellow. Furthermore, the human eye is typically attracted to relatively lighter objects in photographic images. It is possible to produce these lighter objects using fewer droplets of the various colored inks and, consequently, fewer scans. In fact, it has been found that about 60% of the scans necessary to produce typical photographic images do not include any pixels requiring more than five (5) droplets of ink from any single color. If it is not possible to put down all the necessary droplets in a single pass, the processor 22 determines (in real-time) that a second pass is necessary. If a second pass of the swath is not necessary, the printhead moves on to the next swath. Various approaches are available for determining what action to take if all the desired droplets cannot be put onto the printing medium 32 in a single scan.

One approach to printing a swath including pixels requiring more than five (5) droplets of any one (1) color ink is to print five (5) droplets during the first scan. Then, the remaining droplets are printed during subsequent scans over the swath. For example, if the processor 22 determines that it is necessary to print eight (8) droplets of a specific color ink, five (5) droplets are printed during a first scan of the swath and three (3) droplets are printed during a second scan of the swath. If it is desirable to print more than ten (10) droplets of any one (1) color ink during a scan, three (3), four (4), or any number of scans of the swath may be performed. As discussed above, while there are differences in the quality of output produced by an AIP device performing either one (1) scan or two (2) scans, the difference is not very pronounced. The difference in quality is even less pronounced between outputs produced from two (2) and three (3) scans of an AIP device printhead. Therefore, the time required to perform more than two (2) scans of a swath is not typically justified by the benefits achieved.

Another approach to printing a swath including pixels requiring more than five (5) droplets of any one (1) color ink is known as clipping. Clipping involves only printing a maximum of five (5) droplets, regardless of the desired number of droplets calculated by the processor 22. For example, if the processor 22 determines that eight (8) droplets of any one colored ink are necessary to produce the desired color, the processor 22 "clips" the number of droplets it applies to the printing medium 32 to five (5). Therefore, the printhead 30 makes at most one (1) scan of any swath on the printing medium 32. This approach is desirable when speed is more important than quality (e.g., for producing "draft" documents).

Another approach to printing a swath including pixels requiring more than five (5) droplets of any one (1) color ink is known as mapping. Mapping involves determining a number of droplets, which may be printed in a single scan, that corresponds to an original number of droplets that required more than one scan to be printed.

One mapping method divides the original number of droplets by a number (e.g., two (2)) until a result of less than five (5) droplets is achieved. To implement this method, the processor determines the maximum number of droplets of any color that is necessary to achieve the desired colors in the swath. If the processor 22 determines the maximum number of droplets to be nine (9), the number of droplets for each color of each pixel in the swath are divided by two (2). Since 9/2=4.5, which is not an integer, the number is rounded up to 5. Similarly, if the processor 22 determines the maximum number of droplets to be fourteen (14), the number of droplets for each color of each pixel in the swath are divided by three (3) (i.e., 14÷3=4.67, which is rounded up to five (5)). It is important to note if this mapping method is followed, the numbers of droplets for all inks applied to the printing medium 32 are reduced by the same proportion. Therefore, even if the processor 22 originally determines that an only four (4) droplets are to be ejected from an ejector, and the maximum number of droplets of an ink to be ejected is nine (9), only two (2) droplets are printed to represent the original four (4) droplets.

A second mapping method replaces a number of black droplets requested in a swath with a combination of cyan, magenta, and yellow colored droplets. For example, the processor 22 may determine that five (5) droplets of each of black, cyan, magenta, and yellow inks are applied to the printing medium 32 if a ten (10) droplet black color is requested. Five (5) droplets of each of the CMYK inks may be applied in a single pass whereas applying ten (10) droplets of the black ink would require at least two (2) passes. It is to be understood that although the present example produces a ten (10) droplet black color using five (5) droplets of each of the CMYK inks, other mapping methods, in which other amounts of the CMYK inks are used to produce the ten (10) droplet black color, are also contemplated.

Optionally, the user specifies the quality of output that is desired. For example, if the user is satisfied with draft output, one of the mapping methods is chosen to produce the best output possible in a single pass at a relatively high carriage velocity. Alternatively, if the user desires high quality output, no mapping method is implemented and, therefore, any number of passes of a swath will be performed at a relatively low carriage velocity.

The number of droplets ejected from a printhead during a single scan is also a function of carriage velocity. Therefore, it is also contemplated to increase the optical density of ink applied to the printing medium by decreasing the carriage velocity. More specifically, if five (5) droplets of an ink are applied to the printing medium when the carriage passes over the swath at about 16 ips, then ten (10) droplets will be applied when the carriage passes over the swath at about 8 ips. It is also contemplated that the velocity of the carriage be changed as a function of the optical density of the swath currently being printed.

Although the present invention has been described in terms of minimizing the number of scans an AIP device printhead makes of a swath, it is also contemplated to increase the number of scans of a swath in some situations. For example, if the processor determines that the required optical density of ink in a swath would put too much stress on an RF power supply, the processor 22 will cause the printhead 30 to scan the swath multiple times. It is also contemplated to use gamut-skipping for turning-off printheads and/or ejectors for conserving power.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. An apparatus for ejecting droplets of at least one fluid onto a printing medium, comprising:

at least one printhead movably attached to an associated carriage for making a plurality of passes in at least two directions along at least one print swath, each printhead storing a respective one of the at least one fluid;

a plurality of means for ejecting the droplets of the fluids from the respective printheads;

a pass minimization processor which determines a minimum number of passes along a given print swath necessary for achieving a desired fluid droplet density and distribution for a plurality of pixels within the given print swath and a processor, electrically connected to the means for ejecting the droplets, for causing the droplets to be ejected from the printheads in accordance with the minimum number of passes determined by the pass minimization processor.

2. The apparatus for ejecting droplets as set forth in claim 1, wherein each of the means for ejecting the droplets is associated with at least one pixel in one of the respective swaths on the printing medium.

3. The apparatus for ejecting droplets as set forth in claim 2, wherein:

the pass minimization processor determines a maximum number of droplets that are capable of being ejected from each of the ejecting means during one of the passes for at least one of the pixels in the respective swath;

the pass minimization processor determines a desired number of droplets of each of the fluids to eject from the respective printheads for achieving a desired color in each of the pixels; and the pass minimization processor determines an actual number of droplets of each of the fluids to eject from the respective printheads for minimizing the number of passes each of the printheads makes over the swath, the pass minimization processor determining the actual number of droplets as a function of the desired number of droplets.

4. The apparatus for ejecting droplets as set forth in claim 3, wherein four printheads eject the droplets of four respective fluids having different colors.

5. The apparatus for ejecting droplets as set forth in claim 3, wherein the printheads eject the droplets of fluids including cyan, magenta, yellow, and black colors.

6. The apparatus for ejecting droplets as set forth in claim 3, wherein the maximum number of droplets ejected from each of the ejecting means during one of the scans is five.

7. The apparatus for ejecting droplets as set forth in claim 3, wherein if the desired number of droplets for any of the fluids ejected from any of the printheads in the respective swath is greater than the maximum number of droplets, the actual number of droplets for each fluid ejected from each printhead in the respective swath is a fraction of the desired number of droplets, the actual number of droplets being less than or equal to the maximum number of droplets.

8. The apparatus for ejecting droplets as set forth in claim 3, wherein a velocity of the printheads is varied as a function of the actual number of droplets.

9. The apparatus for ejecting droplets as set forth in claim 3, wherein if any of the actual numbers of droplets is less than or equal to the respective maximum number of droplets, the respective ejecting means ejects the respective actual number of droplets during a single one of the scans.

10. The apparatus for ejecting droplets as set forth in claim 3, wherein if the desired number of droplets for a selected one of the fluids ejected from any of the printheads in the respective print swath is greater than the respective maximum number of droplets and the desired number of droplets for the other fluids is less than the respective maximum number of droplets, the actual number of droplets for the selected one of the fluids ejected from each printhead in the respective print swath is less than the respective desired number and the respective actual numbers of droplets for at least one of the other fluids ejected from each printhead in the respective print swath is greater than the respective desired number.

11. An acoustic ink printing device for ejecting droplets of at least one fluid onto a printing medium, comprising:

at least one printing means for ejecting a respective one of the fluids on pixels along a current print swath on the printing medium, each printing means including at least one ejector associated with at least one pixel on the printing medium, each printing means including a means for generating an acoustic wave to eject respective droplets from the ejectors to the respective pixels;

means for determining a minimum number of passes along the current print swath required to achieve a desired color in each of the pixels along the current print swath; and a control processor for controlling the acoustic wave generating means to eject droplets in accordance with the determined minimum number of passes.

12. The acoustic ink printing device as set forth in claim 11, wherein the means for determining a minimum number of passes:

determines a desired number of droplets of each of the fluids to eject from the respective ejectors for achieving the desired color in each of the pixels; and determines an actual number of droplets of each of the fluids to eject from the respective printheads for minimizing the number of scans each of the printheads makes over the current print swath, the processor determining the actual number of droplets as a function of the desired number of droplets.

13. The acoustic ink printing device as set forth in claim 12, wherein if the desired number of droplets for any of the fluids to be ejected from any of the ejectors during a pass of the current print swath is greater than a maximum number of droplets, the actual number of droplets equals the maximum number.

14. The acoustic ink printing device as set forth in claim 13, wherein a maximum number of droplets ejected from each of the ejectors during one of the passes is five.

15. The acoustic ink printing device as set forth in claim 12, wherein four printheads eject the droplets of four respective fluids having different colors.

16. The acoustic ink printing device as set forth in claim 15, wherein the four fluids include high-surface tension inks.

17. The acoustic ink printing device as set forth in claim 16, wherein the four fluids have respective colors of cyan, magenta, yellow, and black.

18. A method for applying droplets of at least one fluid to a printing medium, comprising:

determining a desired color to be printed in each of a plurality of pixels along a current print swath of at least one printhead;

determining a desired number of droplets of each of the fluids to be applied to the respective pixels to achieve the respective desired colors; and based on the desired number of droplets of each of the fluids to be applied to the respective pixels, determining a minimum number of passes along the current print swath to achieve the respective desired colors;

based on the determined minimum number of passes, determining actual numbers of droplets of each of the fluids to be applied to the respective pixels from respective ejectors of the printheads the actual number of droplets being less than a maximum number of droplets capable of being applied to the printing medium by the ejectors in one scan.

19. The method for applying droplets as set forth in claim 18, wherein the step of determining an actual number of droplets of each of the fluids includes:

if the desired number of droplets of any of the fluids is greater than the maximum number of droplets capable of being applied to the printing medium by any of the ejectors, calculating the corresponding actual numbers of droplets by reducing the desired number of droplets by the maximum number until a final result of less than or equal to the maximum number is obtained, the final result being the actual number.

20. The method for applying droplets as set forth in claim 18, wherein the step of determining an actual number of droplets of each of the fluids includes:

if the desired number of droplets of any of the fluids is greater than the maximum number of droplets capable of being applied to the printing medium by any of the ejectors, calculating the corresponding actual numbers of droplets by clipping the desired number of droplets to the maximum number.

21. The method for applying droplets as set forth in claim 18, further including:

selecting a desired output quality level, the actual numbers of droplets being determined as a function of the desired output quality level.

22. The method for applying droplets as set forth in claim 18, further including:

applying the actual numbers of droplets of each of the fluids to the printing medium.

23. In an acoustic ink printing device having a plurality of acoustically-driven ejectors, where each ejector ejects droplets of a different ink, said device applying droplets to pixels within a plurality of swaths on a printing medium, a method for minimizing a number of passes required for a given print swath:

determining a maximum number of droplets that are capable of being ejected from each of the ejectors during one pass for at least one of the pixels in the given swath;

determining a desired number of droplets of each of the inks to eject from the respective ejectors for achieving a desired color in each of the pixels; and determining an actual number of droplets of each of the fluids to eject from the respective ejectors to achieve the desired colors in each pixel, said actual number of droplets being less than the maximum number of droplets capable of being applied to the printing medium by the ejectors in one pass along a print swath.

* * * * *